US007369052B2

(12) United States Patent
Holmgren

(10) Patent No.: US 7,369,052 B2
(45) Date of Patent: May 6, 2008

(54) ANTI-THEFT ALARM TAG

(75) Inventor: Bertil Holmgren, Vellinge (SE)

(73) Assignee: MW Security AB, Malmo (SE)

( * ) Notice: Subject to any disclaimer, the term of this patent is extended or adjusted under 35 U.S.C. 154(b) by 218 days.

(21) Appl. No.: 11/124,488

(22) Filed: May 6, 2005

(65) Prior Publication Data

US 2005/0264424 A1 Dec. 1, 2005

(30) Foreign Application Priority Data

May 7, 2004 (EP) ..... 04010872

(51) Int. Cl.
*G08B 13/14* (2006.01)
*E05B 65/00* (2006.01)

(52) U.S. Cl. ..... 340/572.9; 70/57.1

(58) Field of Classification Search ..... 340/572.9, 340/568.1, 572.8, 384.1, 384.72; 70/57.1
See application file for complete search history.

(56) References Cited

U.S. PATENT DOCUMENTS

| | | | | |
|---|---|---|---|---|
| 4,774,503 | A | 9/1988 | Bussard | |
| 5,416,463 | A * | 5/1995 | Higgins et al. | 340/384.73 |
| 5,438,738 | A * | 8/1995 | Stolz et al. | 24/704.1 |
| 5,841,349 | A * | 11/1998 | Holmgren | 340/572.2 |
| 2002/0003477 | A1 | 1/2002 | Roy, Jr. | |

* cited by examiner

*Primary Examiner*—Davetta W. Goins
(74) *Attorney, Agent, or Firm*—Merchant & Gould P.C.

(57) ABSTRACT

An anti-theft alarm tag comprises two parts (10,12) which shall be located on opposite sides of a product (11) with a pin (14) on one part (12) extending through the product and locked together with the other part (10). Said one part forms a housing comprising a bottom (15) and a cover (16) and enclosing an alarm device (20) and a circuit board (18) with an electronic circuit controlling the alarm device. The pin is connected to the cover or the circuit board and extends through the bottom with slide fit, contact means (39) being switched for activating the alarm device by deformation of the cover or the circuit board, respectively, following an attempt to separate the two parts of the alarm tag.

25 Claims, 3 Drawing Sheets

ANTI-THEFT ALARM TAG

FIELD OF THE INVENTION

The present invention relates to an anti-theft alarm tag comprising two parts, one of which is provided with a pin attached to said one part to be located on one side of a product with the pin extending through the product into locking engagement with the other part, which is to be located on the opposite side of the product. Said one part has a housing which includes a bottom and a cover and encloses an alarm device and an electronic circuit controlling the alarm device. The pin is connected with a deformable element, and contact means in said electronic circuit are switchable to trigger the alarm device by deformation of said element following an attempt to separate said parts.

BACKGROUND

An alarm tag of this type is disclosed in WO 95/27959. In the prior art alarm tag described in this publication the pin is attached to a bottom wall of the housing. Also a bi-stable spring washer is attached to said bottom wall. This washer is operatively related to the electronic circuit and forms a contact element which is normally in a first position in which the alarm device is silent, but is switched via the pin to a second position at attempt to separate the two parts of the alarm tag.

An important aspect relating to anti-theft alarm tags of the type referred to is the manufacturing cost of the tag since the tag is a product which is sensitive to price.

Another aspect is that among shop-keepers there is a great demand for alarm tags that are not only cheaper but also smaller and thinner than those available on the market today.

SUMMARY OF THE INVENTION

A primary object of the present invention is to provide a most reliable anti-theft alarm tag of the type referred to, which can be made small and thin and can be manufactured at low costs.

This object as well as further objects that will be apparent to the skilled man by the description which follows are achieved according to the invention by an alarm tag of the kind referred to above, which is characterized by the features of claim 1. Further features of the invention are defined in the dependent claims.

BRIEF DESCRIPTION OF THE DRAWING

Illustrative embodiments of the alarm tag of the invention will be described below with reference to the accompanying drawings, in which.

DETAILED DESCRIPTION OF PREFERRED EMBODIMENTS

Figure 1:
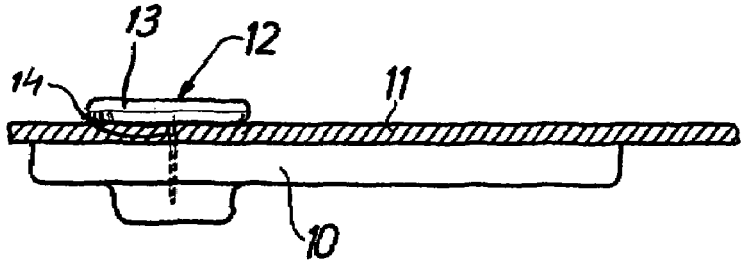
FIG. 1 is a side view of an alarm tag attached to a product shown fragmentarily in cross section.

In FIG. 1 there is shown an alarm tag which comprises a first part 10 including a lock mechanism. Part 10 is applied to one side of a product 11. The alarm tag also comprises a second part 12 including a housing 13 with a pin 14 and enclosing an alarm device. Part 12 is applied to the opposite side of product 11 with pin 14 extending through the product. The pin is easily pushed axially into part 10 but is firmly gripped by the lock mechanism if it is attempted to displace the pin in the opposite direction. Part 12 is thus attached to part 10 by the lock mechanism in such a way that the parts cannot be separated for removal of the alarm tag from the product unless the lock mechanism is operated magnetically or mechanically in a release device at the site in a department store or shop where the product is to be paid for. The lock mechanism can be of any type known in the art including latch members which engage the pin but can be disengaged by mechanical or magnetic actuation by means of the release device, reference is made e.g. to U.S. Pat. No. 5,275,122.

The alarm device is activated if the alarm tag is carried out from a defined area in a department store or a shop due to the fact that the alarm tag then, at the exit from said area, will leave an electromagnetic or electrostatic field maintained in said area, or is carried through such a field maintained between bows located one, at each side of an exit passage, in accordance with a well known technique applied in connection with alarm tags.

Figure 2:
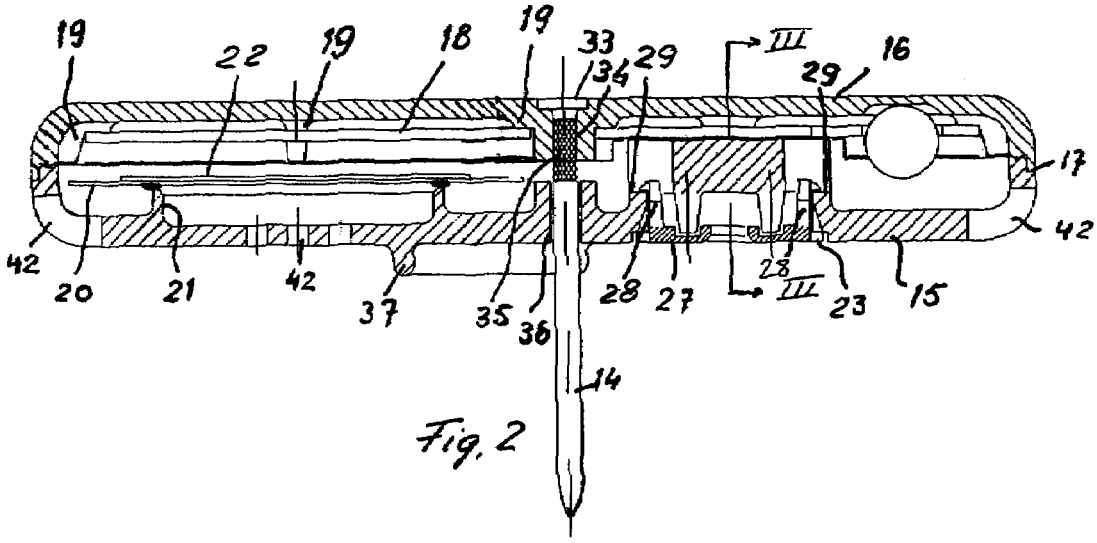
FIG. 2 is an enlarged cross sectional view of that part of the alarm tag which comprises a pin and a housing, in a first embodiment of the invention.

With reference primarily to FIG. 2, housing 13 comprises a bottom 15 and a cover 16 which are made of an impact resistant and preferably elastically deformable material, e.g. polycarbonate, and are welded or fused together at 17. In the space defined by the bottom and the cover there is mounted a circuit board 18 which on the upper side thereof engages protrusions 19 in the cover, which keep the circuit board in a fixed position in the space defined by the bottom and the cover.

A circular sound washer 20 rests on a sharp edge of a circular rim 21 projecting from the upper side of bottom 15, and is attached to the rim by means of an elastic glue, double-stick tape, or any other suitable adhesive. The sound washer includes a circular piezoelectric layer 22 on the upper surface thereof. This layer can be made as a circular disc which is attached to the upper surface of the washer, e.g. by means of an adhesive.

Figure 4:
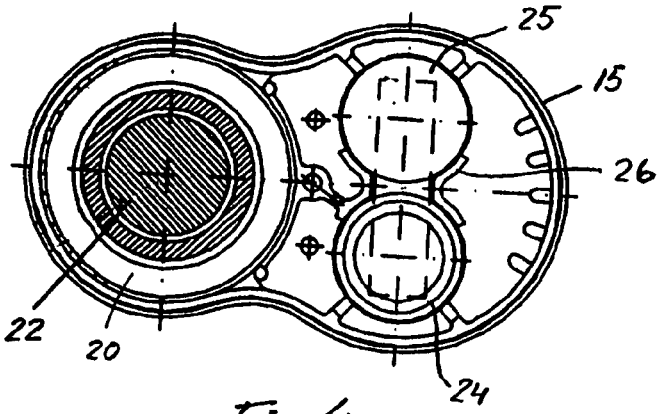
FIG. 4 is a plan view of a bottom of the housing in FIGS. 2 and 3, as seen from the inside thereof.

Openings 23 are provided in the bottom for the insertion of two batteries 24 and 25, of which one has a positive pole facing upwards and the other a positive pole facing downwards. The bottom has upstanding guide formations 26 for localizing the batteries in the correct position, see FIG. 4. A lid 27 for covering openings 23 has spring hooks 28 which at closing of the lid engage sloping surfaces formed by the bottom, the hooks being deflected by sliding against said surfaces when the lid is pushed against the lower side of the bottom to close the openings. The hooks snap into engagement with shoulders 29 in the closed position of the lid.

Figure 5:
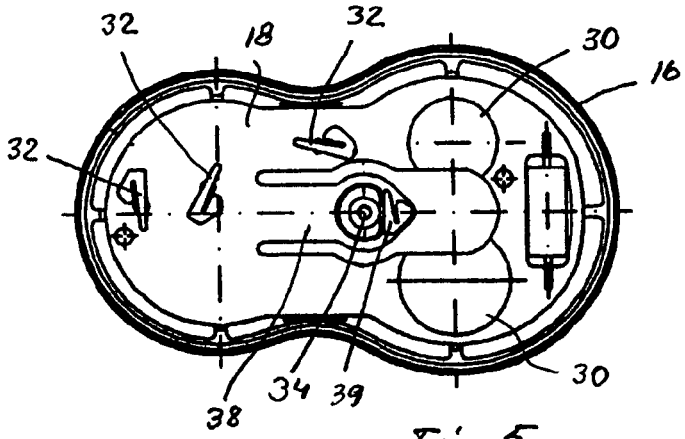
FIG. 5 is a plan view of a cover of the housing as seen from the inside thereof with a circuit board mounted therein.
Figure 7:
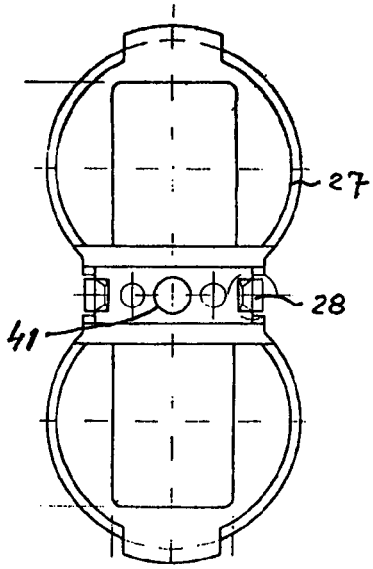
FIG. 7 is a plan view of a battery lid as seen from the inside thereof.
Figure 8:
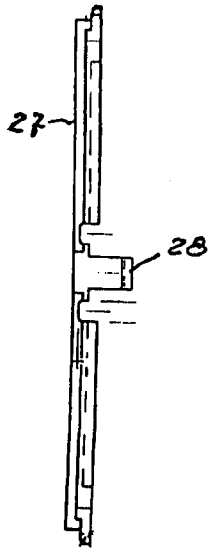
FIG. 8 is a side view of the battery lid.

As shown in FIG. 5, circuit board 18 has contacts 30 for connection of the batteries to the circuit on the circuit board.

Figure 3:
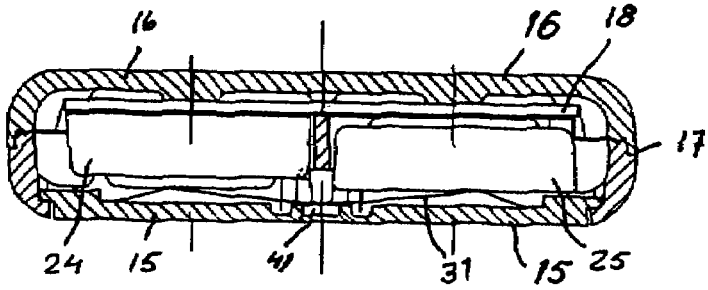
FIG. 3 is a cross sectional view taken along line III-III in FIG. 2.

A spring blade 31 is provided as a contact element connecting the batteries in series, see FIG. 3. There are also on the lower side of the circuit board contact blades 32 which connect the sound washer with the circuit board, see FIG. 5.

According to a first embodiment, shown in FIG. 2, pin 14 has a head 33 and is received in a bore 34 in cover 16, which preferably is shaped such that the head is flush with the upper surface of the cover. A knurled portion 35 of the pin having limited axial length is received in bore 34 with pressure fit so that the pin is attached to cover 16. The pin extends through a bore 36 in bottom 15 with sliding or clearance fit in said bore, and projects from the lower side of the bottom. A semi-circular rib 37 is formed by the bottom at the lower side thereof with the center in bore 36 and this rib makes it difficult to apply pincers against the pin at an attempt to cut the pin between the two parts of the alarm tag. The rib preferably does not extend all the way around the pin as there must be clearance for the battery lid to be mounted and demounted.

Figure 6:
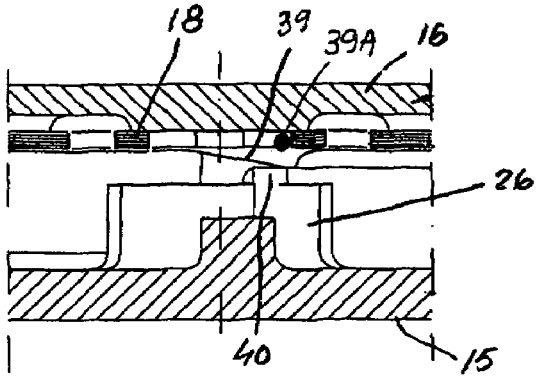
FIG. 6 is a fragmentary enlarged cross sectional view of the housing disclosing a contact device forming part of the electronic circuit.

With reference to FIG. 5, the circuit board forms a tongue 38 with a contact blade 39, which contact blade is attached to the circuit board at one end and is inclined towards the bottom at its other end. Normally this contact blade is supported at the other end by a projection 40 on the battery guide formation 26, see FIG. 6. In this position the contact blade is spaced from an associated contact 39A on the lower side of the circuit board but can be engaged with this contact by flexing of the cover towards the bottom of the housing such that circuit board 18 and particularly contact 39A is brought into contact with contact blade 39 at projection 40. When the alarm tag is applied to a product with the two parts of the tag located on opposite sides of the product and with the pin penetrating the product and locked in part 12, any attempt to separate the two parts 10 and 12 of the alarm tag will consequently cause yielding of the cover towards the bottom so that contact blade 39 will be pressed upwards against the associated contact on the circuit board, which triggers the alarm circuit, including an oscillator circuit and a holding circuit both provided on the circuit board. When the alarm is triggered the oscillator circuit is energized so that the sound washer produces sound and is kept producing sound by means of the holding circuit until this circuit is reset. Reset is effected by short-circuiting battery 24 by means of a needle (not shown) that is applied against contact element 31 through an aperture 41, see FIG. 3, which is not available until the two parts 10 and 12 have been separated. Accordingly, the alarm cannot be stopped until the two parts of the alarm tag have been separated by authorized staff. By means of the needle acting against the contact element 31, battery 24 is short circuited between the positive pole thereof and the shell of the battery. The holding circuit and thus the alarm circuit cannot function with one battery only energizing the holding circuit. Openings 42 are provided in the housing so as to allow the sound produced by the triggered alarm tag to propagate into the surroundings of the tag, see FIG. 2.

The housing of the alarm tag of the invention can be stored without the pin and then when it is to be used can be provided with a pin of suitable length and thickness for combination with a desired part 12.

Figure 9:
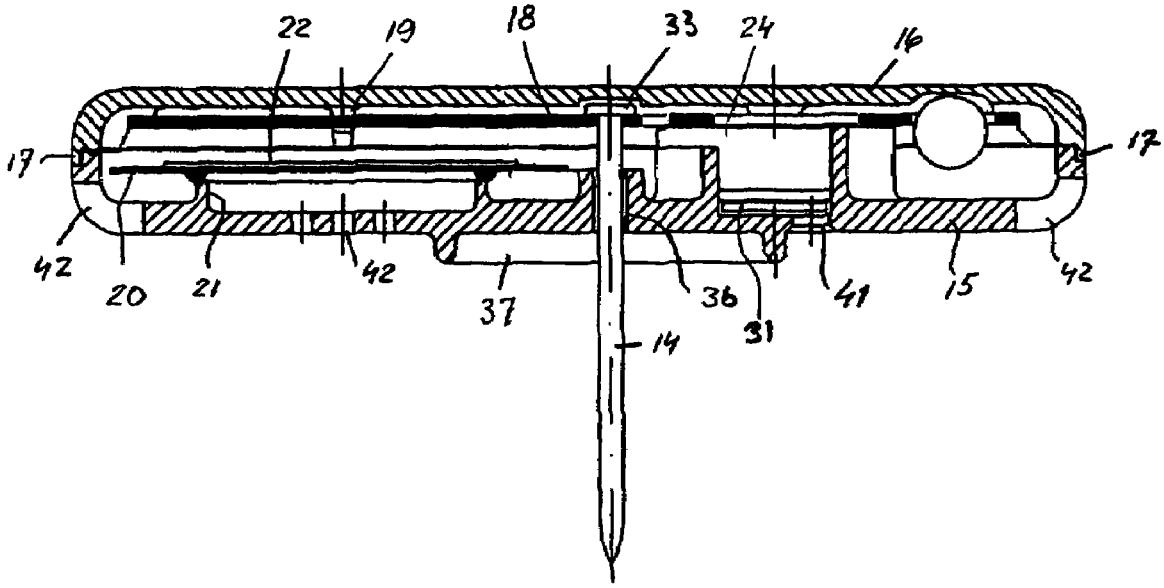
FIG. 9 is a cross sectional view similar to that in FIG. 2 of a second embodiment of the invention.

In the embodiment described, lid 27 can be replaced by an integral part of the bottom which means, however, that the batteries are located in the housing before cover and bottom thereof are interconnected at 17, and then cannot be exchanged. A second embodiment disclosed in FIG. 9 has a battery arrangement of this type, although it should be realized that this battery configuration is equally applicable to the design of the attachment of the pin to cover 16 in FIG. 2. In the embodiment of FIG. 9, rib 37 extends over a complete circle because no space is required for mounting and demounting a battery lid.

The second embodiment includes a further modification, in that pin 14 is attached to circuit board 18 rather than to cover 16. The circuit board is resiliently flexible, and contact blade 39 is mounted in order to function as described in connection with the first embodiment so that when the pin is manipulated in an effort to remove the alarm tag from the product protected by the tag the circuit board will flex and the contact blade will close the electric circuit to trigger the alarm. Otherwise the second embodiment is identical with the first embodiment.

It has been found that alarm tags of similar type as that described herein can be brought out of order by heating the pin by means of a lighter. A specific embodiment of the present invention is devised to overcome this problem. According to this solution, contact blade 39 is inherently biased to take a position in which it is set against the associated contact 39A on the circuit board, but is withheld from this position by a connection element or spacer of wax or another fusible material (not shown) which keeps contact blade 39 spaced from the associated contact 39A on the circuit board. If the connection element or spacer melts due to warming of the pin contact blade 39 due to the inherent bias will bend against the associated contact on the circuit board and thus will trigger the alarm.

The invention claimed is:

1. Anti-theft alarm tag, comprising a housing, which includes an alarm device, a resiliently deformable element, an electronic circuit controlling the alarm device, including contact means adapted to trigger the alarm device upon deformation of the resiliently deformable element, a pin connected to the resiliently deformable element, extending from within the housing with clearance or slide fit through and projecting out from an opening in a wall of the housing, such that pulling of the pin forces the resilient member toward said wall to affect the contact means to trigger the alarm and, wherein the housing comprises a cover and a bottom, from which bottom the pin projects, and the cover forms the resiliently deformable element.

2. The anti-theft alarm tag of claim 1, comprising a complementary member, including a lock mechanism for engagement with the alarm tag by gripping of the pin, which lock mechanism is operable to release the pin.

3. The alarm tag of claim 1, comprising a circuit board supporting the electronic circuit and connected with the housing, which circuit board forms the resiliently deformable element.

4. The alarm tag of claim 2, wherein the contact means comprises a normally open switch in the electronic circuit, devised to be closed by deformation of the deformable element upon an attempt to separate the alarm tag and the complementary member from engagement.

5. The alarm tag of claim 2, comprising a circuit board supporting the electronic circuit and connected with the housing, wherein the contact means comprises a normally open switch, devised to be closed by deformation of the circuit board, which forms the resiliently deformable element, upon an attempt to separate the alarm tag and the complementary member from engagement.

6. The alarm tag of claim 4, wherein the switch comprises a contact blade having a first end mounted to the circuit board, and a second end which, in an open position of the switch, rests against the bottom.

7. The alarm tag of claim 4, wherein the switch comprises a contact blade which is inherently biased towards a closed position and is withheld from the closed position by a spacer fusible by heating thereof.

8. The alarm tag of claim 1, wherein a ridge is provided on an outer side of the bottom, partly or completely encircling the pin.

9. The alarm tag of claim 1, wherein batteries connected with the electronic circuit are permanently enclosed in the housing.

10. The alarm tag of claim 1, wherein the alarm device includes a sound washer which is fixedly attached to a rim formed by the bottom on an inside surface thereof.

11. Anti-theft alarm tag, comprising a housing, which includes an alarm device, a resiliently deformable element, an electronic circuit controlling the alarm device, including contact means adapted to trigger the alarm device upon deformation of the resiliently deformable element, a pin connected to the resiliently deformable element, extending from within the housing with clearance or slide fit through and projecting out from an opening in a wall of the housing, such that pulling of the pin forces the resilient member toward said wall to affect the contact means to trigger the alarm, and a circuit board supporting the electronic circuit and connected with the housing, which circuit board forms the resiliently deformable element.

12. The anti-theft tag of claim 11, wherein the housing comprises a cover and a bottom, from which bottom the pin projects.

13. The anti-theft alarm tag of claim 11, comprising a complementary member, including a lock mechanism for engagement with the alarm tag by gripping of the pin, which lock mechanism is operable to release the pin.

14. The alarm tag of claim 12, wherein a ridge is provided on an outer side of the bottom, partly or completely encircling the pin.

15. The alarm tag of claim 11, wherein batteries connected with the electronic circuit are permanently enclosed in the housing.

16. Anti-theft alarm tag, comprising a housing, which includes an alarm device, a resiliently deformable element, an electronic circuit controlling the alarm device, including contact means adapted to trigger the alarm device upon deformation of the resiliently deformable element, a pin connected to the resiliently deformable element, extending from within the housing with clearance or slide fit through and projecting out from an opening in a wall of the housing, such that pulling of the pin forces the resilient member toward said wall to affect the contact means to trigger the alarm, a complementary member, including a lock mechanism for engagement with the alarm tag by gripping of the pin, which lock mechanism is operable to release the pin, and a circuit board supporting the electronic circuit and connected with the housing, wherein the contact means comprises a normally open switch, devised to be closed by deformation of the circuit board, which forms the resiliently deformable element, upon an attempt to separate the alarm tag and the complementary member from engagement.

17. The anti-theft tag of claim 16, wherein the housing comprises a cover and a bottom, from which bottom the pin projects.

18. The anti-theft alarm tag of claim 16, comprising a complementary member, including a lock mechanism for engagement with the alarm tag by gripping of the pin, which lock mechanism is operable to release the pin.

19. The alarm tag of claim 17, wherein a ridge is provided on an outer side of the bottom, partly or completely encircling the pin.

20. The alarm tag of claim 16, wherein batteries connected with the electronic circuit are permanently enclosed in the housing.

21. Anti-theft alarm tag, comprising a housing, which includes an alarm device, a resiliently deformable element, an electronic circuit controlling the alarm device, including contact means adapted to trigger the alarm device upon deformation of the resiliently deformable element, a pin connected to the resiliently deformable element, extending from within the housing with clearance or slide fit through and projecting out from an opening in a wall of the housing, such that pulling of the pin forces the resilient member toward said wall to affect the contact means to trigger the alarm, and a complementary member, including a lock mechanism for engagement with the alarm tag by gripping of the pin, which lock mechanism is operable to release the pin, wherein the contact means comprises a normally open switch, in the electronic circuit devised to be closed by deformation of the deformable element upon an attempt to separate the alarm tag and the complementary member from engagement, and the switch comprises a contact blade which is inherently biased toward a closed position and is withheld from the closed position by a spacer fusible by heating thereof.

22. The anti-theft tag of claim 21, wherein the housing comprises a cover and a bottom, from which bottom the pin projects.

23. The anti-theft alarm tag of claim 21, comprising a complementary member, including a lock mechanism for engagement with the alarm tag by gripping of the pin, which lock mechanism is operable to release the pin.

24. The alarm tag of claim 22, wherein a ridge is provided on an outer side of the bottom, partly or completely encircling the pin.

25. The alarm tag of claim 21, wherein batteries connected with the electronic circuit are permanently enclosed in the housing.

* * * * *